US006616151B1

(12) United States Patent
Golling

(10) Patent No.: US 6,616,151 B1
(45) Date of Patent: Sep. 9, 2003

(54) APPARATUS FOR GLIDING OVER SNOW

(76) Inventor: Eugene Golling, P.O. Box 15368, Los Angeles, CA (US) 90015

( * ) Notice: Subject to any disclaimer, the term of this patent is extended or adjusted under 35 U.S.C. 154(b) by 0 days.

(21) Appl. No.: 09/969,805

(22) Filed: Oct. 2, 2001

(51) Int. Cl.[7] ..... A63C 9/086

(52) U.S. Cl. ..... 280/14.21; 280/14.24; 280/617; 280/632; 280/634

(58) Field of Search ..... 280/611, 612, 280/11.3, 617, 618, 623, 626, 629, 633, 14.21, 14.22, 14.24

(56) References Cited

U.S. PATENT DOCUMENTS 3,925,911 A * 12/1975 Erlebach ..... 36/117.4
3,927,897 A * 12/1975 Olson et al. ..... 280/612
4,050,716 A * 9/1977 Kubelka et al. ..... 280/614
4,140,331 A * 2/1979 Salomon ..... 280/612
4,251,090 A * 2/1981 Weigl ..... 280/618
4,261,595 A * 4/1981 Smialowski et al. ..... 280/614
4,279,433 A * 7/1981 Petaja ..... 280/605
4,385,773 A * 5/1983 Scheck et al. ..... 280/612
4,465,295 A * 8/1984 Spademan ..... 280/612
4,512,594 A * 4/1985 Eyre ..... 280/614
4,589,673 A * 5/1986 Dimier et al. ..... 280/630
4,703,946 A * 11/1987 Nava ..... 280/627
4,917,399 A * 4/1990 Holzl ..... 280/615
5,143,396 A 9/1992 Shaanan et al.
5,143,397 A 9/1992 Stepanek et al.
5,498,017 A * 3/1996 Rohrmoser ..... 280/633
5,558,355 A 9/1996 Henry
5,954,357 A * 9/1999 Golling ..... 280/612
6,224,086 B1 5/2001 Golling

* cited by examiner

*Primary Examiner*—Brian L. Johnson
*Assistant Examiner*—Bridget Avery
(74) *Attorney, Agent, or Firm*—James E. Brunton

(57) ABSTRACT

A universal snow boot and binding for use in connection with either snow skiing or snow boarding which is easy to use and provides quick, easy and positive interconnection of the snow boot with the upper surface of the ski or snowboard. The snow boot or foot enclosure component of the invention carries a permanent magnet that engages a metal plate provided on the snowboard. The mechanical locking mechanism that is operated by the user is also strategically mounted on the snowboard. The mechanical locking component includes a toe locking mechanism and a cooperating heel locking mechanism that is easily operable to enable the snow boot to be readily disconnected from the upper surface of the snowboard or snow ski.

20 Claims, 11 Drawing Sheets

70
76b
82
78
80
-70a-
76
30
20
-72
22
-76a-
32
14
66
87
84b
-14a-
91
84
33
62
63
60
37
89
42
40
52
54
46
50a
84a
50

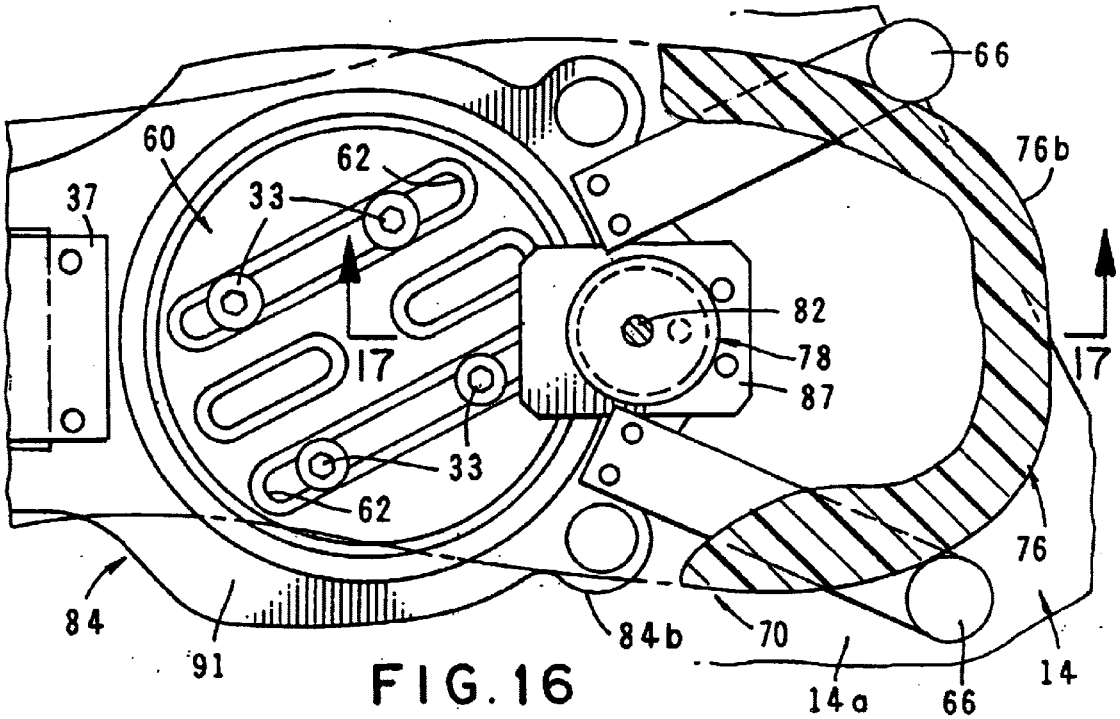
FIG. 16
FIG. 17
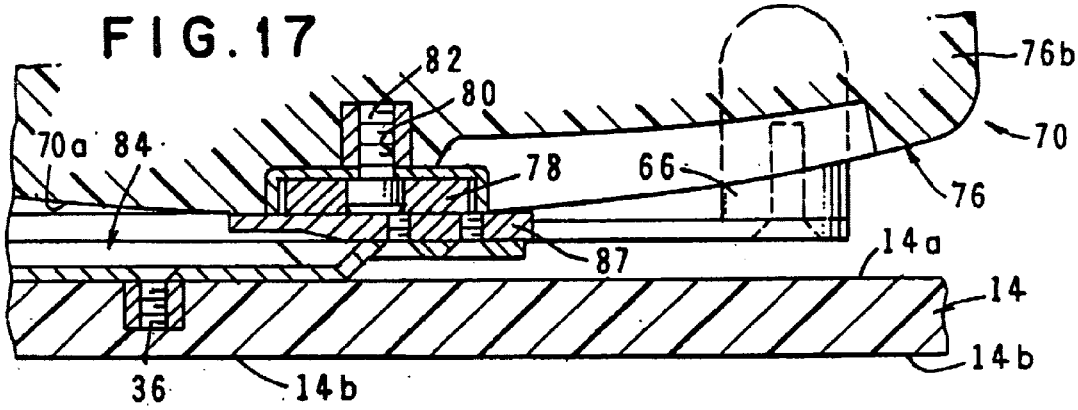
FIG. 18
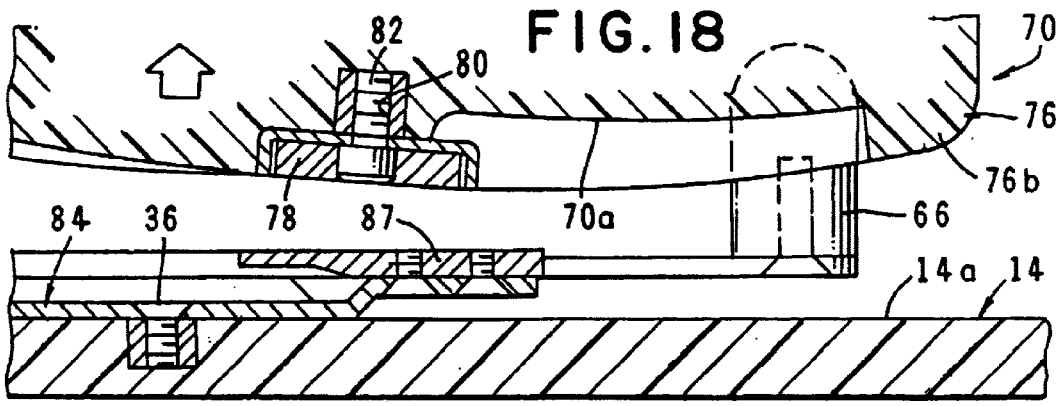

APPARATUS FOR GLIDING OVER SNOW

BACKGROUND OF THE INVENTION

1. Field of the Invention

The present invention relates generally to a winter sport apparatus. More particularly, the invention concerns an apparatus for gliding over snow which includes unique snow boots that are removably connected to a snow engaging support base such as a snow-board through the use of a magnet and a cooperating mechanical locking mechanism.

2. Discussion of the Prior Art

Winter sports such as skiing, ice-skating and a snowshoeing have traditionally been very popular in many locations within the United States and in foreign countries. While, for many years snow skiing was the sport of choice among winter sport enthusiasts, recently, the sport of snowboarding has catapulted into popularity particularly among young persons.

With the increase in popularity of snow boarding has come the demand for better and easier-to-use equipment. Particularly in demand is the need for superior boots and bindings. As a general rule, the boots and bindings used for snow boarding are the same as used for snow skiing and closely resemble those which have been used for over fifty years. Typically, the bindings comprise rather heavy, bulky frames which are affixed to the upper surface of the snow-board with the boots being affixed to the frames by conventional types of straps, buckles and wires of the character used in snow skiing. These types of bindings are generally cumbersome, difficult to use and often fail to provide a type of interconnection between the boots and the snowboard that is essential to the sport of snow boarding.

A substantial improvement in snowboard, boots and bindings is described in U.S. Pat. No. 6,224,086 B1 issued to the present inventor. The novel apparatus of the invention described in this patent comprises a unique snow boot binding in which only magnetic forces are used to removably affix the snow boot to a ski or snowboard. The apparatus also includes novel means for quickly and easily disconnecting the snow boot from the upper surface of the snowboard or snow ski, which carries the magnetic elements of the apparatus. In one form of the invention this novel release mechanism comprises an easy-to-use, hand-operated lever which enables the skier or the snow-boarder to quickly and easily disconnect the snow boot from the upper surface of the ski or snowboard.

Other recent improvements in snow sport bindings are those described in U.S. Pat. No. 5,558,355 issued to Henry. The Henry patent describes a binding which is particularly suitable for snow boarding and provides an easy-to-use, kick-in boot engagement feature and a number of convenient ways to disengage the boot in a relative small, light-weight, and economical structure. Another type of ski binding is disclosed in U.S. Pat. No. 5,143,397 issued to Stepanek et al. This patent describes a part for a ski binding comprising a carriage slidably attached to a base plate. One end of the base plate is fastened to the ski with fasteners while the other end rests freely on the bottom of a U-shaped clamp also fastened to the ski with fasteners. Attachment of the carriage to the base is accomplished by carriage structural features that retain the carriage in the clamp and further carriage structural features that prevent the carriage from being vertically disengaged from the part of the base adjacent to the base plate fastened end.

Still another improved binding for a snowboard is that described in U.S. Pat. No. 5,143,369 issued to Shaanan et al.

The Shaanan et al patent concerns a binding for a snowboard that has a base, side members extending upwardly and rearwardly from the sides of the base with an arcuate member joining the rear ends of the side members. Fastening means on one of the side members and one side edge of the board at the front provide for attachment of one end of two straps. Fastening means on the other side member and on the other side edge serve for attachment of a locking bar, which, in turn, connects the other end of each strap to the side member and base.

The foregoing prior art patents represent some of the more recent attempts to improve the quality of snow boots and bindings particularly for use in connection with snow boarding. While the devices disclosed in the aforementioned patents constitute substantial improvements over the prior art, they nevertheless remain somewhat complicated in design, bulky and, in some cases, difficult to use.

The thrust of the present invention is to overcome the drawbacks of the prior art snow-ski and snow-board boots and bindings and to provide a magnet-carrying boot and binding that is easy to use and one that enables the quick and positive interconnection of the snow boots with the upper surface of the snow-board.

SUMMARY OF THE INVENTION

It is an object of the present invention to provide a universal snow boot and binding for use in connection with either snow skiing or snow boarding which is easy to use and provides quick, easy and positive interconnection of the snow boot with the upper surface of the ski or snow-board. More particularly, it is an object of the invention to provide a highly novel snow boot and binding in which magnetic forces in cooperation with a novel mechanical locking mechanism are used to removably affix the snow boot to the ski or snowboard.

Another object of the invention is to provide an apparatus of the aforementioned character in which the snow boot or foot enclosure carries a permanent magnet while the mechanical locking mechanism is strategically mounted on the snow board.

Another object of the invention is to provide an apparatus as described in the preceding paragraph in which the mechanical locking mechanism includes a toe locking mechanism and a cooperating heel locking mechanism that is easily operable to enable the snow boot to be readily disconnected from the upper surface of the snow-board or snow ski.

Another object of the invention is to provide an apparatus as described in the preceding paragraph in which the heel locking mechanism comprises an easy-to-use, hand-operated lever that enables the skier or the snow-boarder to quickly and easily disconnect the snow boot from the upper surface of the ski or snow-board.

Another object of the invention is to provide an apparatus of the character described in which the snow boot carries a toe locking tab that is removably receivable within a tab receiving locking element carried by the snow board.

Another object of the invention is to provide an apparatus of the character described in the preceding paragraphs which is light-weight, is simple to manufacture and install, and is virtually fail-safe in operation.

Another object of the invention is to provide a novel ski boot and cooperating binding which is compact, lightweight and is of a simple, straight forward construction that and can be inexpensively manufactured.

BRIEF DESCRIPTION OF THE DRAWINGS

FIG. 16 is a fragmentary, top plan view, partly broken away to show internal construction, illustrating the forward portion of the foot enclosure assembly of FIG. 14 in position within the binding assembly shown in FIG. 15.

FIG. 17 is a cross-sectional view taken along lines 17—17 of FIG. 16.

FIG. 18 is a side-elevational, cross-sectional view similar to FIG. 17, but showing the foot enclosure assembly being separated from the binding assembly.

DESCRIPTION OF THE INVENTION

Figure 1A:
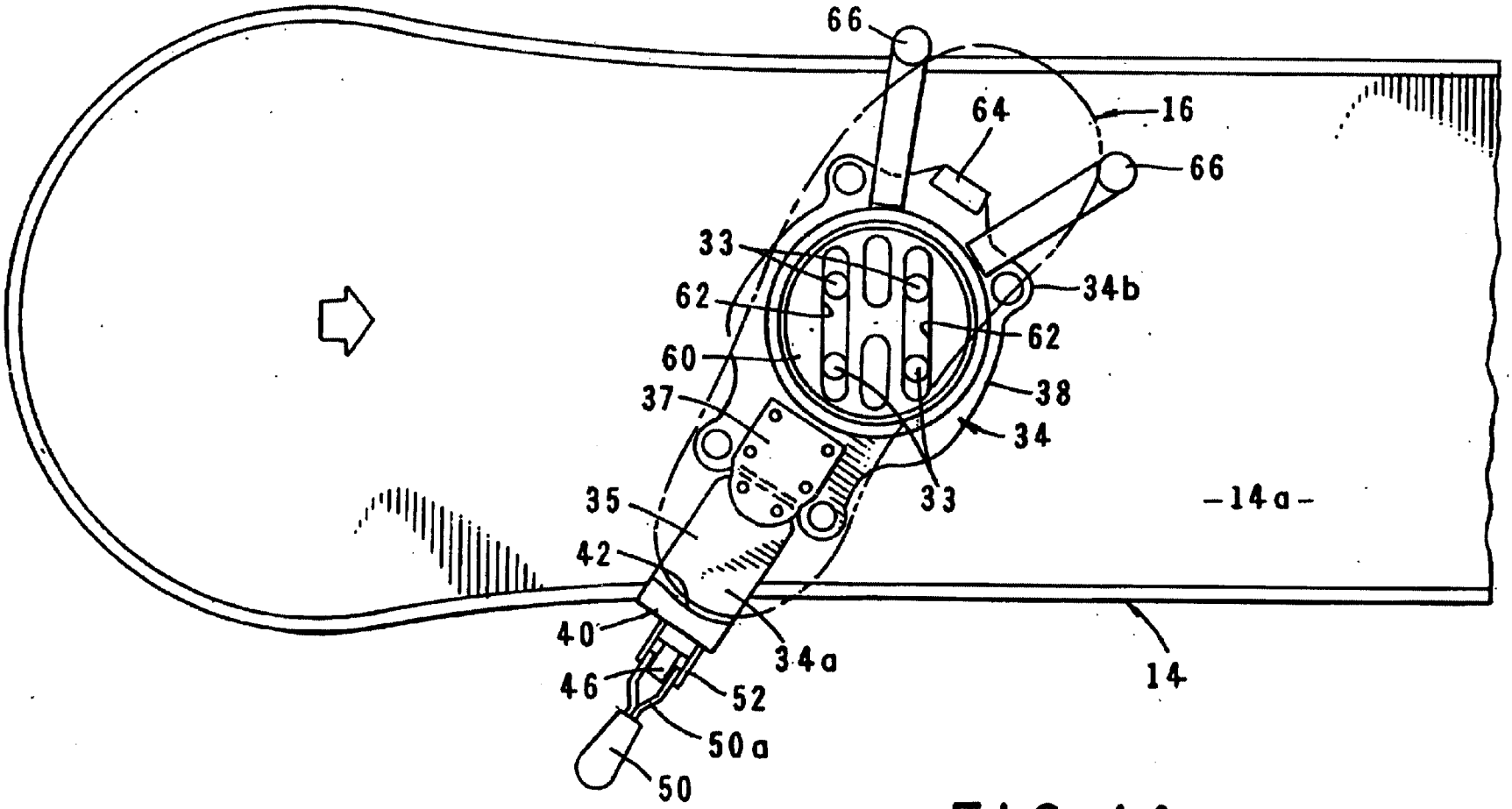
FIGS. 1A and 1B, when considered together, comprise a top plan view of one form of the apparatus of the invention for gliding over the snow.
Figure 1B:
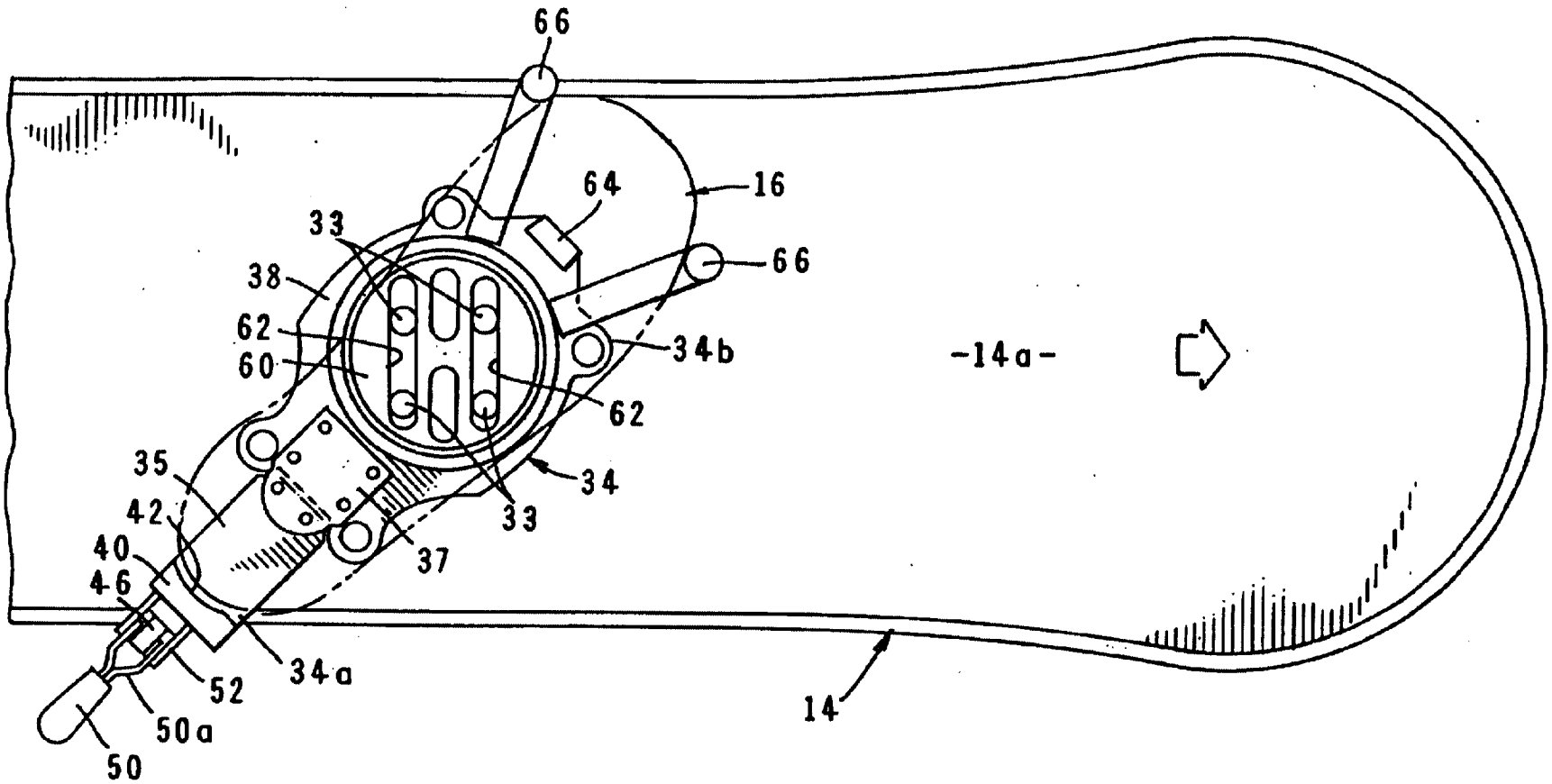

Referring to the drawings and particularly to FIGS. 1 through 13, one form of the apparatus of the invention for gliding over snow is there shown. In this form of the invention, the principal cooperating components comprise a support base 14, a pair of identical foot enclosure assemblies 16, and connector means connected to the support base for releasably interconnecting the foot enclosure assemblies with the support base. Support base 14 includes an upper surface 14*a* and a lower surface 14*b* and, in the form of the invention shown in FIGS. 1 through 13, comprises a snowboard.

Figure 3:
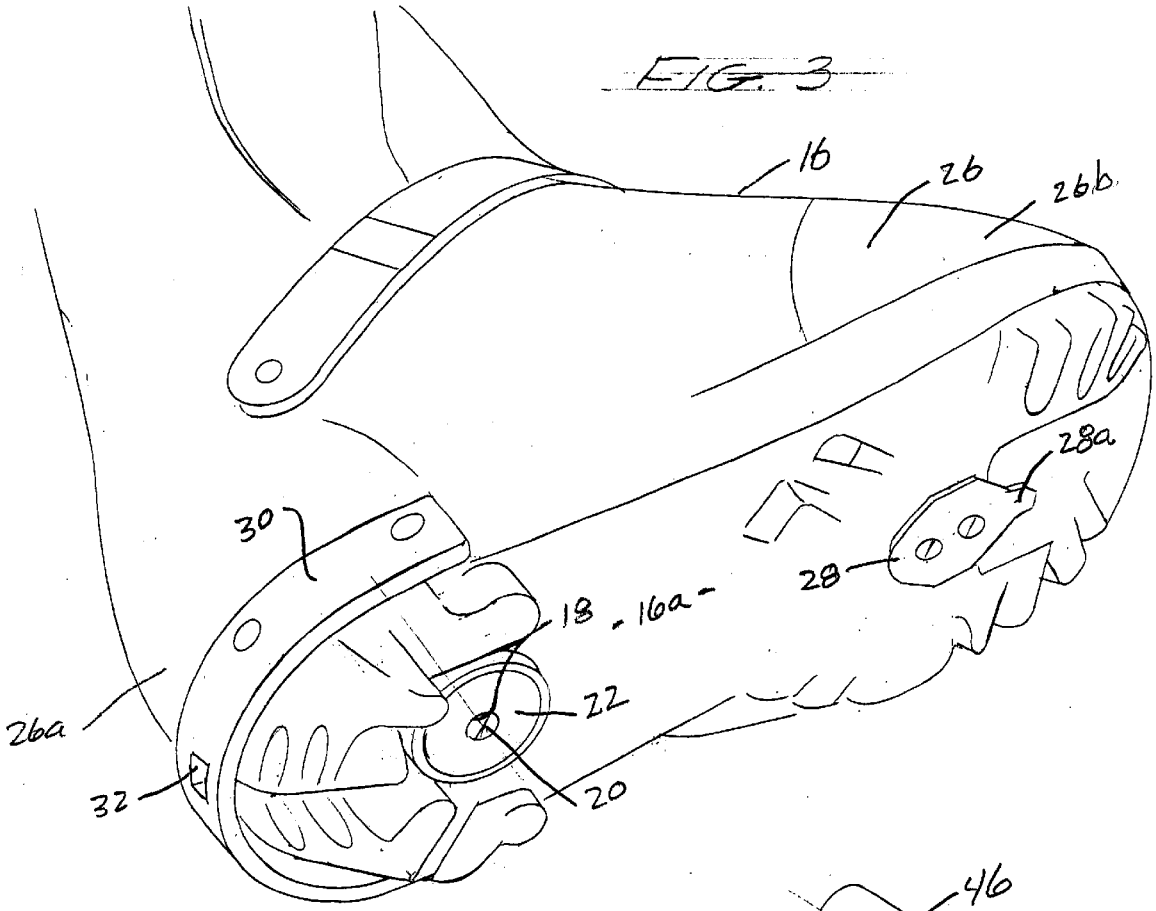
FIG. 3 is a generally perspective bottom view of one form of the foot enclosure assembly of the invention.
Figure 5:
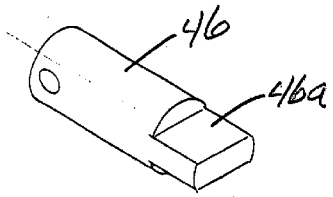
FIG. 5 is a generally perspective view of the locking pin of the assemblage shown in FIG. 4.
Figure 4:
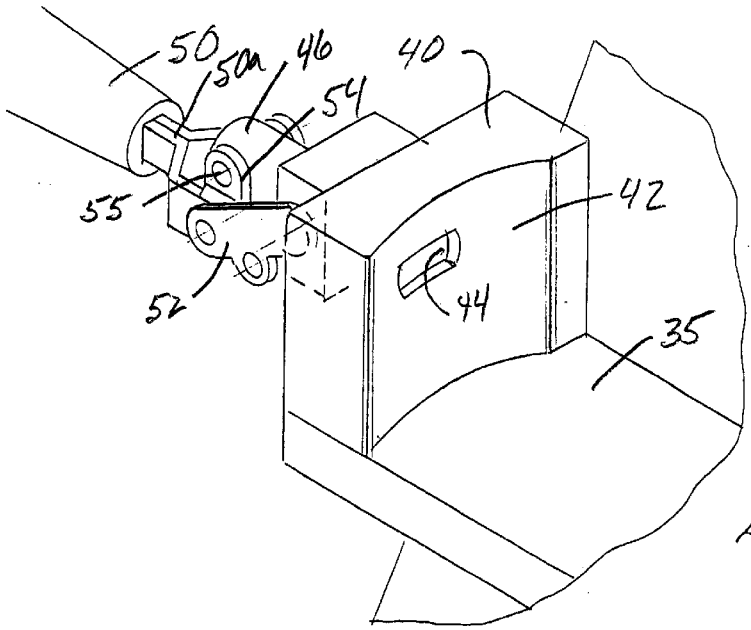
FIG. 4 is a greatly enlarged, generally perspective, fragmentary view of the rear locking portion of the binding assembly shown in FIG. 2.
Figure 7A:
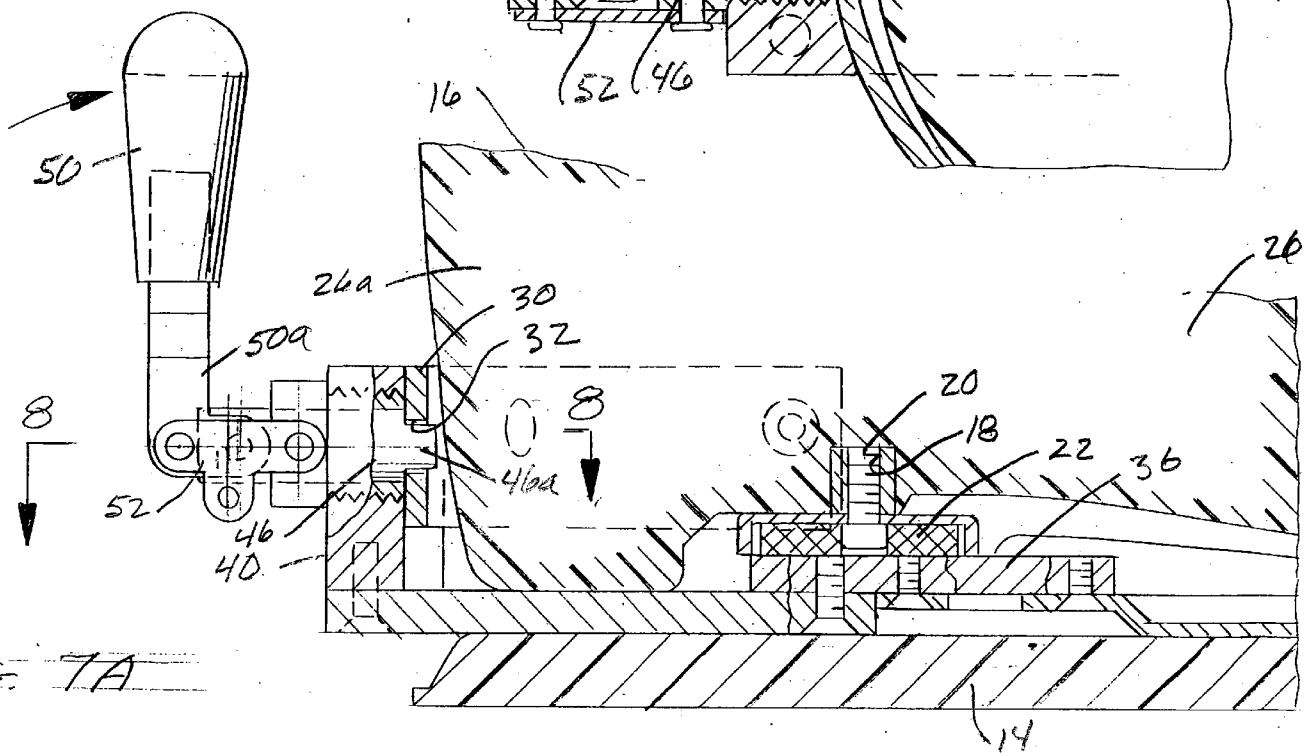
FIGS. 7A and 7B, when considered together, comprise an enlarged cross-sectional view taken along lines 7—7 of FIG. 6.
Figure 9:
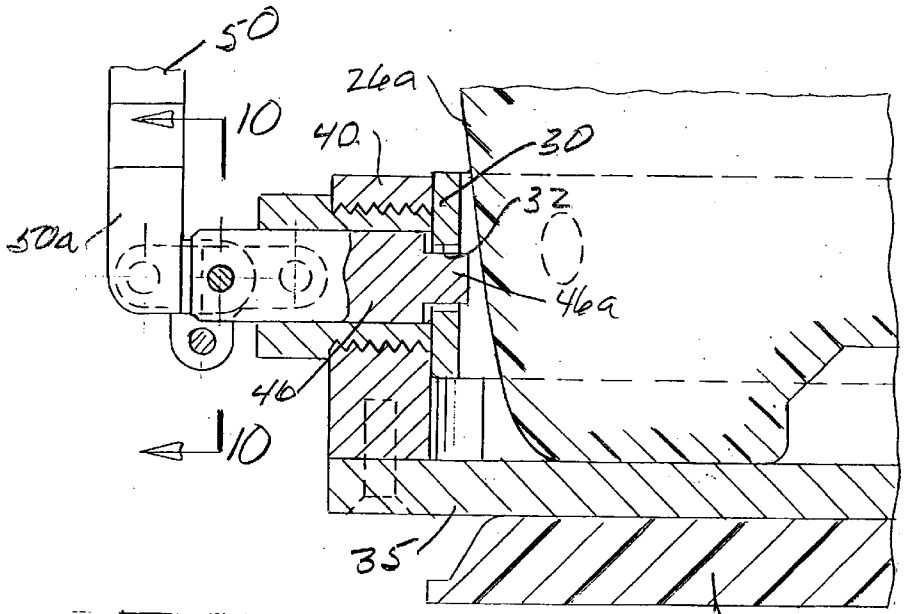
FIG. 9 is a cross-sectional view taken along lines 9—9 of FIG. 8.
Figure 7B:
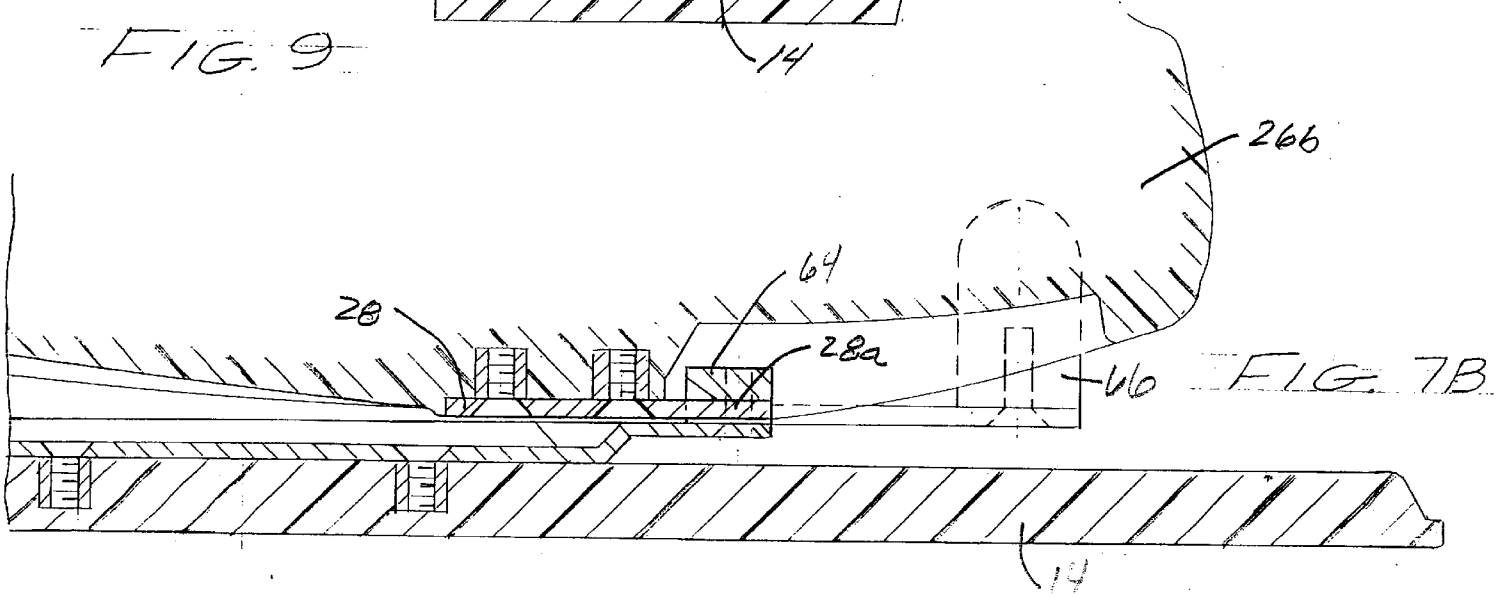
Figure 12:
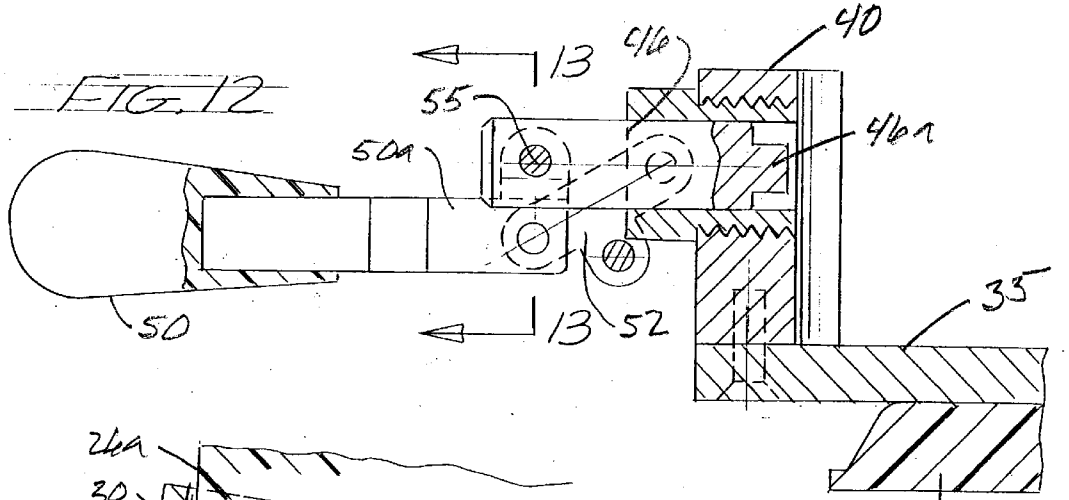
FIG. 12 is a cross-sectional view taken along lines 12—12 of FIG. 11.

As best seen in FIGS. 3 and 7A, the lower surface 16*a* of each of the foot enclosure assemblies is provided with a threaded bore 18 that receives a threaded stud 20 that functions to connect a generally circular shaped permanent magnet 22 with the foot enclosure assembly. Magnet 22 is of a high holding power, compact design, and can be constructed from various materials. By way of example, magnet 22 can comprise powerful ceramic disk, permanent magnet of a character readily commercially available from various sources including A-L-L Magnetics, Inc. of Palencia, Calif. This type of ceramic magnet can be constructed in various configurations and, if desired, can be encased in nickel-plated steel cups. Magnet 22, which is commercially available in a number of different sizes, can range in diameter from about 2 inches to about 3 inches. It is to be understood that in constructing the apparatus of the present invention, a single, relatively large magnet can be used, or in the alternative, a plurality of smaller magnets disposed in a suitable array can be used to provide the magnetic forces necessary to releasably secure the heel portion of the foot enclosure assembly of the apparatus to the support base.

Referring to FIGS. 3, 6, 7A and 7B the foot enclosure assembly 16 of the present invention can be seen to comprise a snow boot-like foot enclosure 26 having a heel portion 26*a* and a toe portion 26*b*. As best seen in FIG. 3 magnet 22 is affixed to the lower surface of the foot enclosure means intermediate the heel portion and the toe portion. For a purpose presently to be described, a toe locking member 28 having an outwardly extending locking tab 28*a* is affixed to the lower surface of the foot enclosure means proximate the toe portion. Also affixed to the lower surface of the foot enclosure means proximate the heel portion thereof is foot enclosure locking means for releasably locking the heel portion of the foot enclosure means to support base 14. This means here comprises a generally "U" shaped heel-locking member 30 having an opening or bore 32 therethrough.

Figure 2:
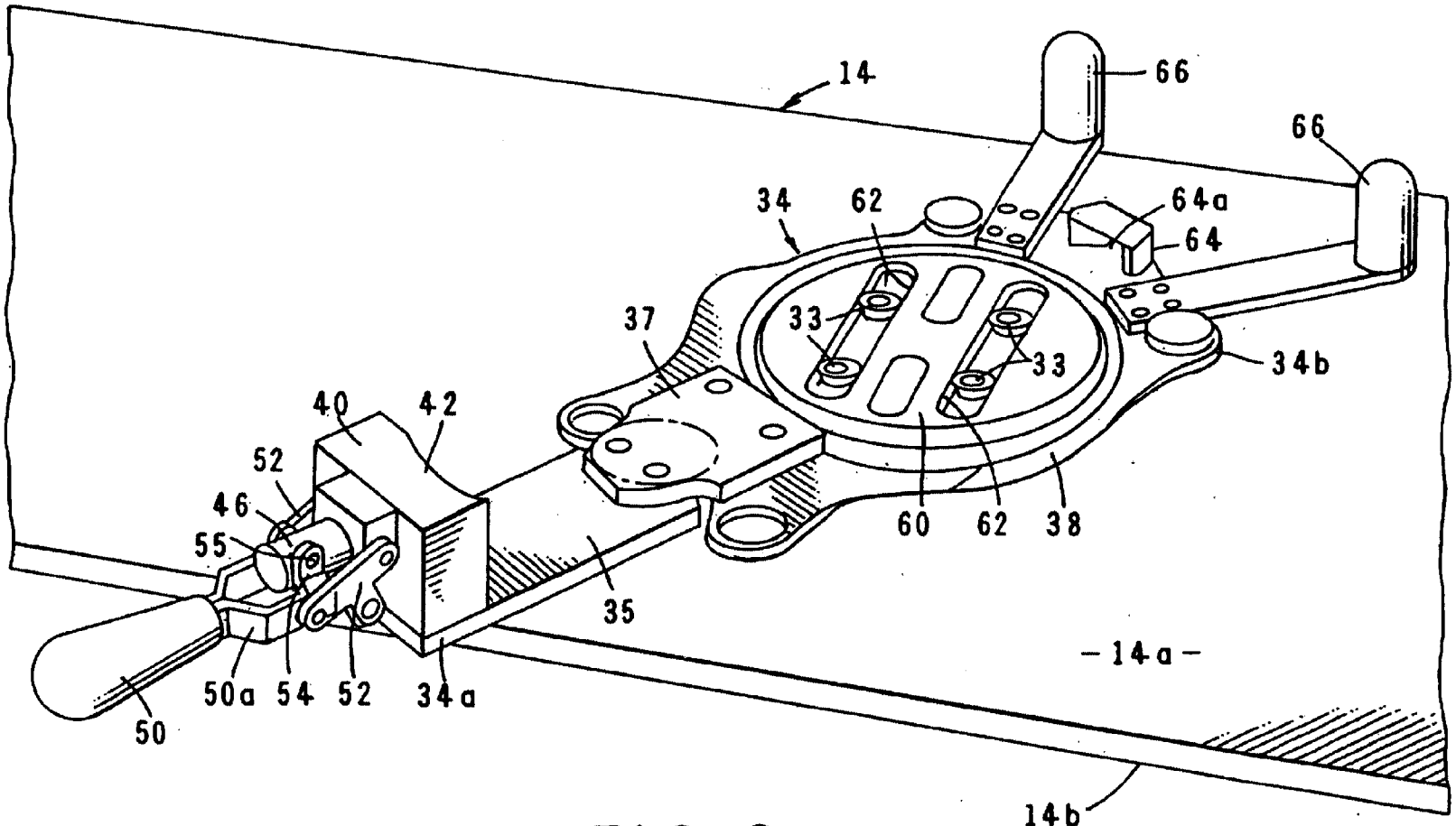
FIG. 2 is a greatly enlarged, generally perspective view of one of the binding apparatus of the invention for releasably connecting the foot enclosure assembly of the invention to the support base.

Turning to FIG. 2, one of the two identical connector means of the invention for releasably interconnecting the entire foot enclosure assemblies 16 with the support base 14 can be seen to comprise an elongated frame-like assembly 34 having a first end 34*a* and a second end 34*b*. Each of the assemblies 34 is adjustably connected to support base 14 by two sets of threaded connectors 33.

Affixed to each of the frame assemblies intermediate the first and second ends thereof is a ferrous metal plate 36 that is engageable by magnets 22 when the foot enclosure assemblies 16 are mated with the frame assemblies in a manner presently to be described. The ferrous metal plates 36 comprise a part of the heel securement means of the invention for securing the heel portion of the foot enclosure assemblies 16 within their respective frame assemblies.

Figure 8:
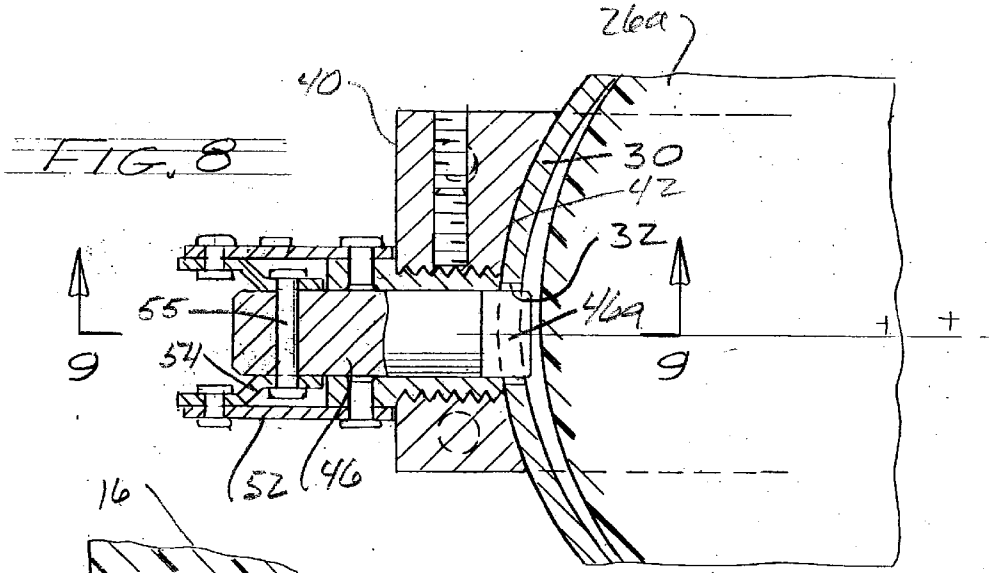
FIG. 8 is a cross-sectional view taken along lines 8—8 of FIG. 7A.

The heel securement means of the invention also includes heel locking means for locking engagement with the heel portion of one of the foot enclosure assemblies 16. Each of the identical heel locking means here comprises an upstanding heel-receiving block 40 that is connected to base portion 35 of its respective frame assembly 34. Block 40 has a concave surface 42 and a bore 44 there through for telescopically receiving the locking tongue end portion 46*a* of an elongated, generally cylindrically shaped locking pin 46 that is carried by block 40. (See FIGS. 4, 5, 7A, 8 and 9). Also comprising a part of the heel locking means of the present invention is finger gripping means that includes a finger gripping lever 50 having a yoke portion 50*a* that is pivotally connected to heel receiving block 40 and to locking pin 46 by means of connecting links 52 and 54 respectively. As best seen in FIG. 8, a transverse pin 55 interconnects link 54 with locking pin 46. With this construction, lever 52 can be moved between the upward, boot locking position shown and FIGS. 7A and 9, wherein end 46*a* of the locking pin is received within opening 32 of locking member 30 and the downward release position shown in FIGS. 2, 4, 10A and 12 wherein the end of the locking pin is retracted from opening 32.

As is also shown in FIG. 2 each frame assembly 34 includes a generally disk shaped connector member 60 that is roatably mounted within a central opening 63 formed in base portion 37. Connector member 60 comprises a part of the adjustment means of the invention for adjustably interconnecting the frame assemblies 34 with support base 14. More particularly, by loosening threaded connectors 33, the framed assembly can be rotated relative to connector 60 in a manner to vary the angle of the frame assembly with respect to support base 14. Similarly, connector member 60 is provided with a pair of spaced apart parallel slots 62 that receive threaded connectors 36. With this construction, by loosening threaded connectors 33, each connector member 60 can be moved transversely of the support base to adjust the transverse position of frame assembly 34 on the upper surface 14*a* on support base 14.

Figure 6:
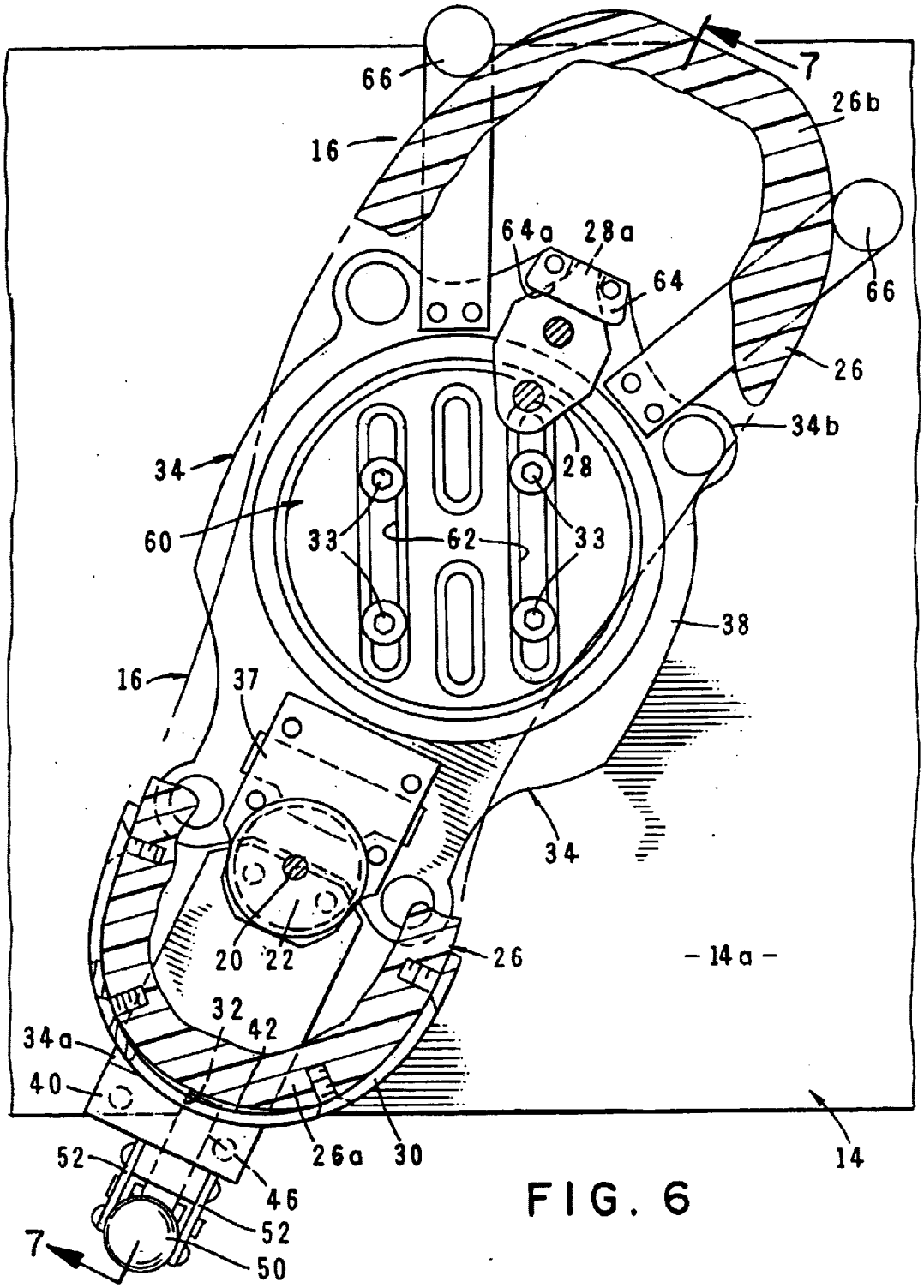
FIG. 6 is a top plan view partly broken away to show internal construction of one of the foot enclosure assemblies that is interconnected with one of the binding assemblies of the character shown in FIG. 2.

The connector means of the present form of the invention further comprises toe-securement means for securing the toe portion of foot enclosures 16 within their respective frame assemblies 34. Each of the identical toe locking means here comprises an upstanding locking element or bracket 64 that is connected to the frame assembly proximate second end 34*b* thereof (FIG. 2). Bracket 64 is provided with an opening 64*a* that closely receives locking tab 28*a* of toe locking member 28 when a foot enclosure 16 is positioned within a frame assembly 34 in the manner shown in FIG. 6. In this regard, to initially correctly position the foot enclosures 16 within the frame assemblies 34, positioning means are provided on each of the frame assemblies proximate end 34*b* thereof. As shown in FIG. 6, these positioning means here comprise a pair of upstanding locating pins 66 that are engageable by the forward portion of foot enclosure assembly 16 when the foot enclosure assembly is properly positioned within its respective frame 34 with the locking tab 28*a* thereof correctly positioned within opening 64*a* of bracket 64.

Figure 10:
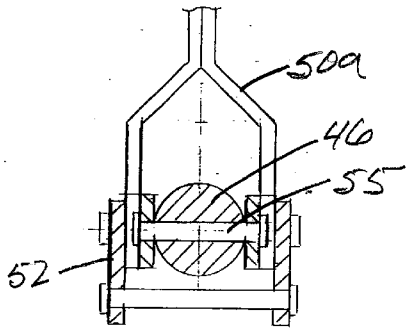
FIG. 10 is a cross-sectional view taken along lines 10—10 of FIG. 9.
Figure 10A:
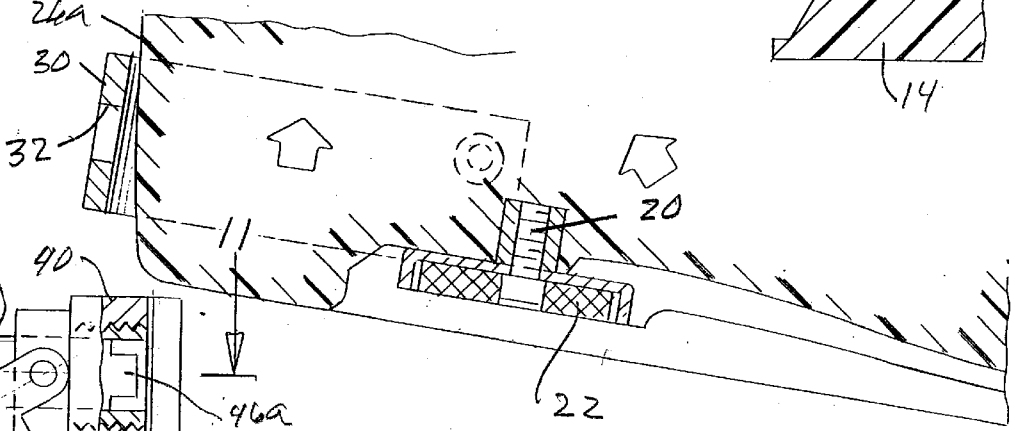
FIGS. 10A and 10B, when considered together comprise a side-elevational, cross-sectional view similar to FIGS. 7A and 7B but showing the foot enclosure assembly of the invention being separated from the clamping assembly.
Figure 10A:
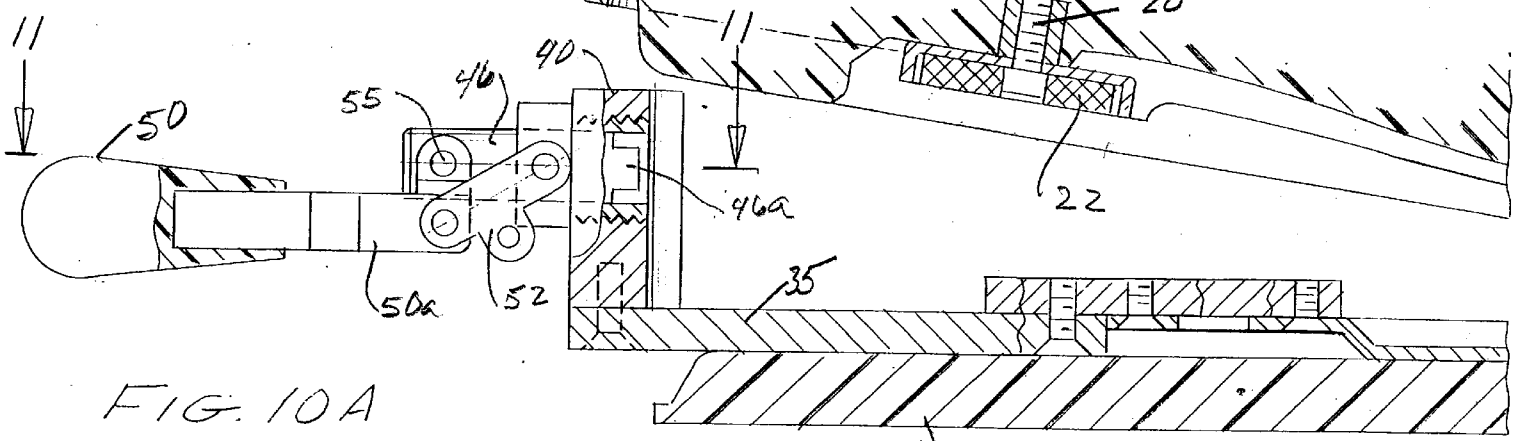
Figure 13:
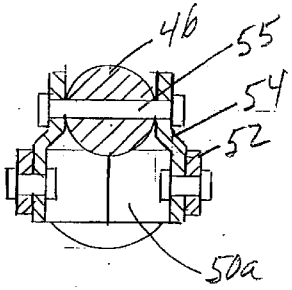
FIG. 13 is a cross-sectional view taken along lines 13—13 of FIG. 12.
Figure 11:
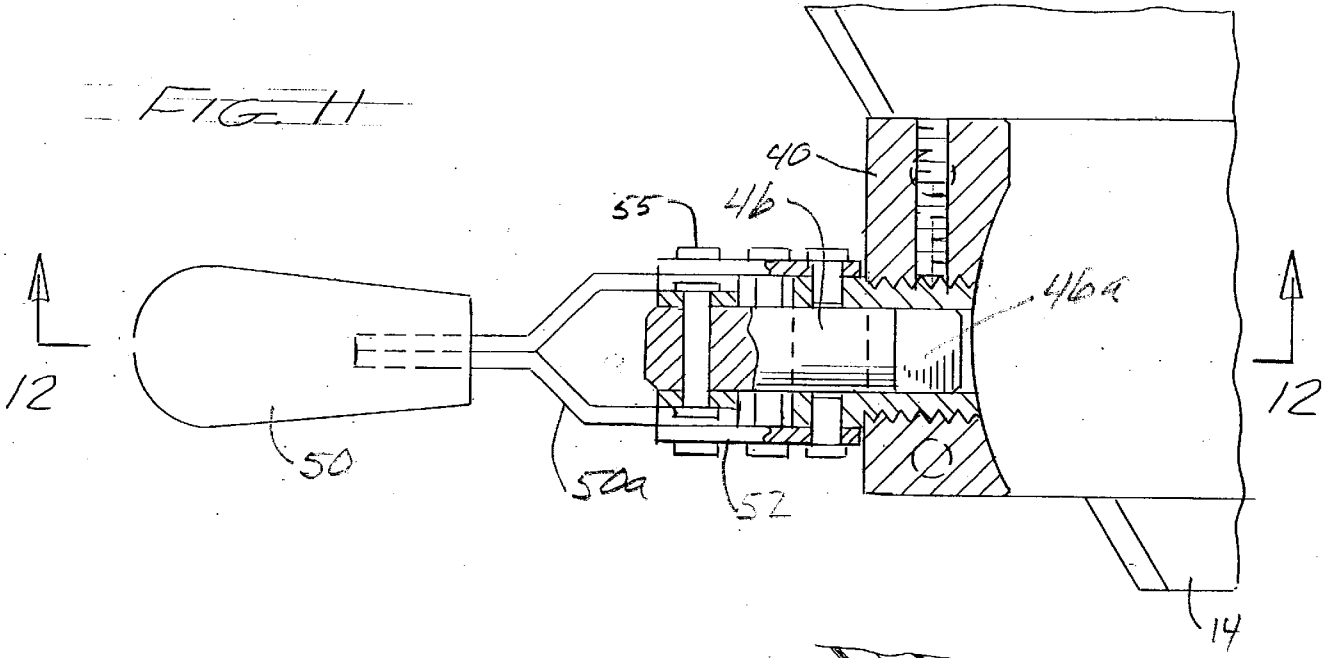
FIG. 11 is a cross-sectional view taken along lines 11—11 of FIG. 10A.
Figure 10B:
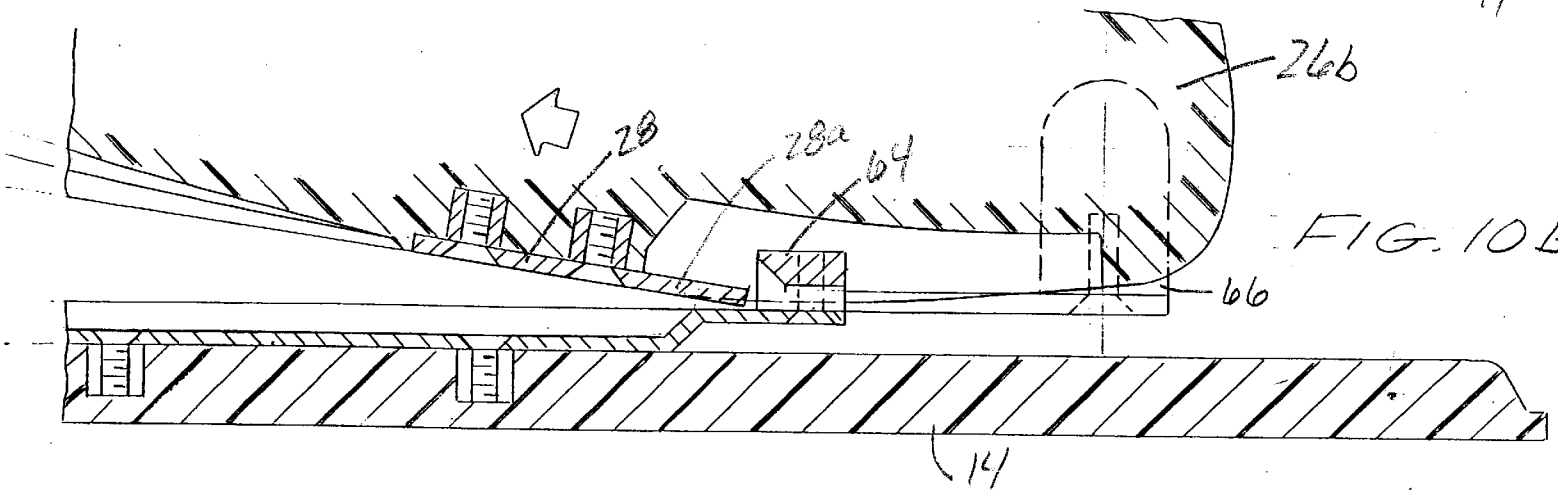

The foot enclosures can be removed from their respective frame assemblies in the manner illustrated in FIGS. 10A and 10B. More particularly, by moving lever 50 into the downward position shown in an FIG. 10A, the user can lift the heel of the foot enclosure upwardly in the direction of the arrows of FIG. 10A against the urging of magnet 22 so that the heel portion moves free of the frame assembly. This done, the user can move the foot enclosure rearwardly in the direction of the arrow of FIG. 10B so that tab 28*a* of the toe locking member slides free of the locking element 64. To interconnect the foot enclosure with the frame assembly, the reverse procedure is, of course, followed.

Turning now to FIGS. 14 through 18, an alternate form of the apparatus of the invention for gliding over snow is there shown. This form of the invention is similar in many respects to that shown in FIGS. 1 through 13 and like numerals are used in FIGS. 14 through 18 to identify like components. As in the earlier described embodiment of the invention, the principal cooperating components of this latest embodiment comprise a support base 14, a pair of foot enclosure assemblies 70, and connector means connected to the support base for releasably interconnecting the foot enclosure assemblies with the support base.

Figures 14, 15:
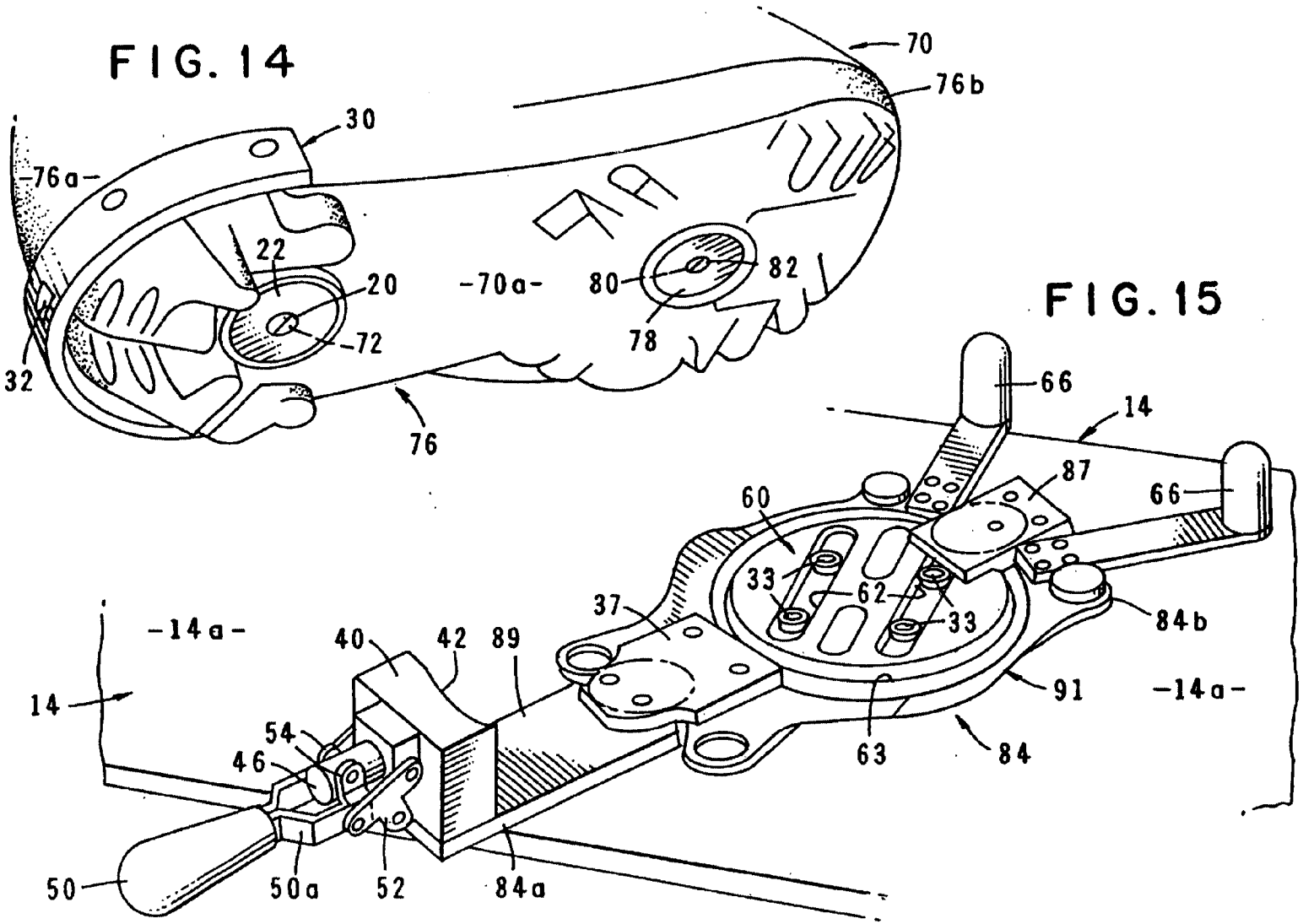
FIG. 14 is a generally perspective bottom view of an alternate form of foot enclosure assembly of the invention.
FIG. 15 is a generally perspective view of an alternate form of binding assembly of the apparatus of the invention.

As best seen in FIG. 14, the lower surface 70*a* of the foot enclosure assembly is provided with a threaded bore 72 that receives a threaded stud 20 that functions to connect a generally circular shaped permanent magnet 22 with the foot enclosure assembly. Magnet 22 is of the character previously described and can comprise a powerful ceramic disk, permanent magnet of a character readily commercially available from various sources including A-L-L Magnetics, Inc. of Palencia, Calif.

Referring to FIGS. 14, 16, 17 and 18, each of the identical foot enclosure assemblies 70 of the present invention can be seen to comprise a snow boot-like foot enclosure 76 having a heel portion 76*a* and a toe portion 76*b*. As best seen in FIG. 14, magnet 22 is affixed to the lower surface of the foot enclosure means intermediate the heel portion and the toe portion. For a purpose presently to be described, a second magnet 78 is affixed to the lower surface of the foot enclosure means proximate the toe portion. As illustrated in FIGS. 14 and 17, the foot enclosure assembly is provided with a second threaded bore 80 that receives second threaded stud 82 that functions to connect the generally circular shaped permanent magnet 78 with the foot enclosure assembly. Magnet 78 also comprises a powerful ceramic disk, permanent magnet of a character readily commercially available from various sources including A-L-L Magnetics, Inc. of Palencia, Calif. Also affixed to the foot enclosure means proximate the heel portion thereof is a generally "U" shaped heel-locking member 30 having an opening or bore 32 therethrough.

The important connector means of this latest form of the invention for releasably interconnecting the foot enclosure assemblies 70 with the support base 14 comprises a pair of identical, elongated frame-like assemblies 84, one of which is shown in FIG. 15. This assembly has a first end 84*a*, a second end 84*b* and is adjustably connected to support base 14 by two sets of threaded connectors 36. Affixed to each of the frame assemblies intermediate it's first and second ends is a ferrous metal plate 37 that is engageable by a magnet 22 when the foot enclosure assembly 70 is mated with the frame assembly in a manner presently to be described. Also affixed to the frame assembly intermediate the first and second ends is a second ferrous metal plate 87 that is engageable by magnet 78 when the foot enclosure assembly 70 is mated with the frame assembly in a manner shown in FIG. 17. Ferrous metal plate 87 here comprises a part of the toe securement means of this latest form of the invention for securing the toe portion of the foot enclosure within the frame assembly. Like frame assembly 34, frame assembly 84 comprises two interconnected base portions 89 and 91 and is adjustably interconnected with support 14 in the manner previously described.

Affixed to each frame assembly 84 proximate the heel end 84*a* is a heel locking means for locking engagement with the heel portion of said foot enclosure assembly and more particularly with locking member 30. This important heel locking means is identical in construction and operation that described in connection with the embodiment of the invention shown in FIG. 1 through 13 and comprises an upstanding heel-receiving block 40 that is connected to base portion 89. Block 40 has a bore 44 therethrough for telescopically receiving the locking tongue end portion 46*a* of an elongated, generally cylindrically shaped locking pin 46. (See FIGS. 4, 5, 7A, 8 and 9).

Also comprising a part of the heel locking means of the invention is finger gripping means that includes a finger gripping lever 50 having a yoke portion 50*a* that is pivotally connected to heel receiving block 40 and to locking pin 46 by means of connecting links 52 and 54 in the manner previously described. This heel locking means functions in the identical manner previously described.

As is also shown in FIG. 15, each frame assembly 84 includes a generally disk shaped connector member 60 that is rotatably mounted within a central opening 63 formed in base portion 91. Connector member 60 comprises a part of the adjustment means of the invention for adjustably interconnecting the frame assembly 84 with support base 14 in an identical manner to that described in the embodiment shown in FIGS. 1 through 13. More particularly, by loosening threaded connectors 36, the frame assembly can be rotated relative to connector 60 in a manner to vary the angle of the frame assembly with respect to support base 14. Similarly, connector member 60 is provided with a pair of spaced apart parallel slots 62 that receive threaded connectors 36. With this construction, by loosening threaded connectors 36, connector member 60 can be moved transversely of the support base to adjust the transverse position of frame assembly 34 on the upper surface 14*a* on support base 14.

The foot enclosures can be removed from their respective frame assemblies in the manner previously discussed and as illustrated in FIGS. 17 and 18. More particularly, by moving lever 50 into the downward position shown in FIGS. 10A and 15, the user can lift the heel of the foot enclosure upwardly in the direction of the arrows of FIG. 10A so that the heel portion moves free of the frame assembly. This done, the user can move the toe portion of the foot enclosure upwardly in the direction of the arrow of FIG. 18 so that the toe locking member, or second magnet 78 releases from metal plate 87 in the manner shown.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. An apparatus for gliding over snow comprising:

(a) at least one foot enclosure assembly having a toe portion and heel portion and including a magnet affixed thereto intermediate said toe portion and said heel portion;

(b) at least one support base having an upper surface and a lower snow-engaging surface;

(c) connector means connected to said support base for releasably interconnecting said foot enclosure assembly with said support base, said connector means including:

(i) a frame connected to said support base and having a first end and a second end; and (ii) heel securement means connected to said frame for securing said heel portion of said foot enclosure assembly within said frame, said heel securement means comprising:

a. a ferrous metal plate affixed to said frame intermediate said first and second ends, said ferrous metal plate being engageable by said magnet affixed to said foot enclosure assembly;

b. heel locking means connected to said frame proximate said first end for locking engagement with said heel portion of said foot enclosure assembly, said heel locking means comprising a locking pin an upstanding heel receiving block connected to said support base, said block having a concave surface for receiving said heel portion of said foot enclosure assembly and including a bore therethrough for telescopically receiving said locking pin; and (iii) toe securement means connected to said frame proximate said second end thereof for securing said toe portion of said foot enclosure assembly within said frame.

2. The apparatus as defined in claim 1 in which said foot enclosure assembly includes a generally "U" shaped heel locking member affixed to said heel portion of said foot enclosure assembly, said heel locking member having an opening therein for telescopically receiving said locking pin, said locking means further including finger gripping means connected to said locking pin for moving said locking pin relative to said opening in said heel locking member.

3. The apparatus as defined in claim 1 in which said foot enclosure assembly includes a toe locking member having a locking tab and in which said toe securement means comprises a locking element having an opening for receiving said locking tab of said toe locking member.

4. The apparatus as defined in claim 1 in which said foot enclosure assembly includes a second magnet and in which said toe securement means comprises a second ferrous metal plate engageable by said second magnet.

5. The apparatus as defined in claim 1 in which said frame includes positioning means engageable by said foot enclosure assembly for positioning said foot enclosure assembly within said frame.

6. The apparatus as defined in claim 1 in which said frame further includes adjustment means for adjustably interconnecting said frame with said support base.

7. The apparatus as defined in claim 6 in which said frame is provided with a central opening and in which said adjustment means comprises a generally disk shaped connector member rotatably mounted within said central opening.

8. The apparatus as defined in claims 7 further including threaded connectors carried by said connector member for interconnecting said connector member with said support base.

9. An apparatus for gliding over snow comprising:

(a) at least one foot enclosure assembly having a toe portion and heel portion and including:

(i) a magnet affixed thereto intermediate said toe portion and said heel portion; and (ii) a heel locking member affixed to said heel portion, said heel locking member having an opening therein; and (iii) a toe locking member affixed to said foot enclosure assembly proximate said toe portion, said toe locking member having a locking tab;

(b) at least one support base having an upper surface and a lower snow-engaging surface;

(c) connector means connected to said support base for releasably interconnecting said foot enclosure assembly with said support base, said connector means including:

(i) a frame connected to said support base and having a first end and a second end;

(ii) a ferrous metal plate affixed to said frame intermediate said first and second ends, said ferrous metal plate being engageable by said magnet affixed to said foot enclosure assembly;

(iii) heel locking means connected to said frame proximate said first end for locking engagement with said heel portion of said foot enclosure assembly said heel locking means comprising an upstanding heel receiving block connected to said support base, said heel receiving block having a bore therethrough, said heel locking means further comprising:

a. a locking pin having a locking tongue telescopically receivable within said bore of said upstanding heel receiving block and within said opening of said heel locking member; and b. finger gripping means connected to said locking pin for moving said locking pin relative to said opening in said heel locking member; and (iv) toe securement means connected to said frame proximate said second end for locking engagement with said toe portion of said foot enclosure assembly, said toe securement means comprising a locking element having an opening for receiving said locking tab of said toe locking member.

10. The apparatus as defined in claim 9 in which said frame includes positioning means engageable by said foot enclosure assembly for positioning said foot enclosure assembly within said frame, said positioning means comprising a pair of upstanding locating pins.

11. The apparatus as defined in claim 10 in which said frame further includes adjustment means for adjustably interconnecting said frame with said support base.

12. The apparatus as defined in claim 11 in which said frame is provided with a central opening and in which said adjustment means comprises a generally disk shaped connector member rotatably mounted within said central opening.

13. The apparatus as defined in claim 12, further including threaded connectors carried by said connector member for interconnecting said connector member with said support base.

14. An apparatus for gliding over snow comprising:

(a) at least one foot enclosure assembly having a toe portion and heel portion and including:

(i) a magnet affixed thereto intermediate said toe portion and said heel portion; and (ii) a heel locking member affixed to said heel portion, said heel locking member having an opening therein; and (iii) a toe locking member affixed to said foot enclosure assembly proximate said toe portion;

(b) at least one support base having an upper surface and a lower snow engaging surface;

(c) connector means connected to said support base for releasably interconnecting said foot enclosure assembly with said support base, said connector means including:

(i) a frame connected to said support base and having a first end and a second end, said frame further including adjustment means for adjustably interconnecting said frame with said support base;

(ii) a ferrous metal plate affixed to said frame intermediate said first and second ends, said ferrous metal plate being engageable by said magnet affixed to said foot enclosure assembly;

(iii) heel locking means connected to said frame proximate said first end for locking engagement with said heel portion of said foot enclosure assembly, said heel locking means comprising an upstanding heel receiving block connected to said support base, said heel receiving block having a concave surface for receiving said heel portion of said foot enclosure assembly and having a bore therethrough, said locking means further including:

a. a locking pin having a locking tongue telescopically receivable within said opening of said heel locking member; and b. finger gripping means connected to said locking pin for moving said locking pin relative to said opening in said heel locking member; and c. toe locking means connected to said frame proximate said second end for locking engagement with said toe locking member of said foot enclosure assembly.

15. The apparatus as defined in claim 14 in which said toe locking member comprises a second magnet and in which said toe locking means comprises a second ferrous metal plate affixed to said frame intermediate said first and second ends, said ferrous metal plate being engageable by said second magnet.

16. The apparatus as defined in claim 14 in which said toe locking member comprises a locking member having a locking tab and in which said toe locking means comprises a locking element having an opening for receiving said locking tab of said locking member.

17. The apparatus as defined in claim 14 in which said finger gripping means comprises a finger gripping lever pivotally connected to said heel receiving block and to said locking pin for movement between an upward position wherein said locking pin is received within said opening in said heel locking member and a downward position wherein said locking pin is retracted from said opening and said heel locking member.

18. The apparatus as defined in claim 14 in which said frame is provided with a central opening and in which said adjustment means comprises a generally disk shaped connector member rotatably mounted within said central opening.

19. The apparatus as defined in claims 18 further including threaded connectors carried by said connector member for interconnecting said connector member with said support base.

20. The apparatus as defined in claims 19 in which said connector member includes a slot and in which said threaded connectors carried by said connector member are disposed within said slot.

* * * * *